US005183249A

United States Patent [19]

Ichikawa

[11] Patent Number: 5,183,249

[45] Date of Patent: Feb. 2, 1993

[54] PAPER CONVEYOR

[75] Inventor: Kiyomichi Ichikawa, Tokyo, Japan

[73] Assignee: Auto-Stamp Institute Inc., Tokyo, Japan

[21] Appl. No.: 575,072

[22] Filed: Aug. 30, 1990

[30] Foreign Application Priority Data

Dec. 12, 1989 [JP] Japan ..... 1-322062

[51] Int. Cl.[5] ..... B65H 29/58

[52] U.S. Cl. ..... 271/186; 271/291; 271/303

[58] Field of Search ..... 271/304, 305, 186, 303, 271/291

[56] References Cited

U.S. PATENT DOCUMENTS 4,078,789 3/1978 Kittredge ..... 271/186 X
4,256,299 3/1981 Hogenson ..... 271/302 X
4,691,914 9/1987 Lawrence ..... 271/305 X

FOREIGN PATENT DOCUMENTS 45713 6/1982 European Pat. Off. .
297282 1/1989 European Pat. Off. .
333067 9/1989 European Pat. Off. .
2363382 8/1974 Fed. Rep. of Germany .
3721515 10/1988 Fed. Rep. of Germany .

*Primary Examiner*—Richard A. Schacher
*Attorney, Agent, or Firm*—Kane, Dalsimer, Sullivan, Kurucz, Levy, Eisele and Richard

[57] ABSTRACT

A paper conveyor for conveying paper includes a conveyor roll for conveying paper, a drive motor for driving and rotating the conveyor roll, a rotary follower roll for pressing onto the conveyor roll and for holding a paper and a convey direction switch mechanism for switching the conveying direction of the paper. The paper is conveyed in a predetermined direction by the conveyor roll and the rotary follower roll. When the conveying direction of the paper is changed to an opposite direction, the convey direction switch mechanism is adapted to control the follower roll so that the follower roll can be rocked from one direction to another with its axis of rocking coinciding with an axis of the conveyor roll. Therefore, the conveying direction of the paper can be changed very smoothly.

7 Claims, 6 Drawing Sheets

PAPER CONVEYOR

BACKGROUND OF THE INVENTION

1. Field of the Invention

The present invention relates to a paper conveyor for feeding paper. More particularly, the present invention relates to a paper conveyor which can be used for supplying paper to business machines such as a laser printer and a copying machine and which can also be applied to, for instance, an automatic sheet setting machine which is used when a single piece of paper to be treated that is conveyed sequentially is collected until a plurality of pieces of paper are accumulated and a predetermined number of pieces of paper among them are automatically bound to carry out bookbinding. The present invention also relates to improvement in automatic sheet setting machines as described in Japanese Patent Publication (Kokai) Nos. Sho 62-124282, Sho 62-87396 and Sho 62-164703.

2. Description of Related Arts

The conventional paper conveyors of the types described above have been designed so that an automatic sheet setting machine can be connected thereto in different directions appropriately selected in accordance with situations and the direction in which paper is conveyed can be changed from one direction to another. Therefore, the conventional conveyors for feeding paper are usually provided with various switching mechanism for switching the direction in which paper is conveyed in order to change it.

For instance, when direction in which paper is to be conveyed must be selected from two directions, the conventional switching mechanisms for switching the direction in which paper is conveyed includes a guide member which is positioned at a branching portion of the paper conveyor and whose direction can be changed, and the direction in which paper is conveyed can be switched as by rocking the guide member from one direction to another to thereby switch the direction in which paper is guided.

However, the conventional paper conveyor of the above-described type has a problem that clogging of paper tends to occur due to difference in frictional resistance between the guide member of the switching mechanism for switching the direction in which paper is conveyed and the paper to be conveyed. Therefore, attempts to switch the direction in which paper is conveyed with a small radius of curvature in order to miniaturize the paper conveyor leads to further increase in the frictional resistance, as the result of which the clogging of paper tends to occur. This is one reason why the reliability of paper conveyance is deteriorated greatly. In addition, such switching mechanism for switching the direction in which paper is conveyed by the change of the direction of the guide member is disadvantageous because it cannot be applied to sheets made of a very soft material.

In order to ensure a more reliable conveyance of paper, it has also been proposed to construct the paper conveyor so that paper can be conveyed by holding it between two conveyor belts and the positions of the conveyor belts can be varied so as to enable the switching of the direction in which paper is conveyed. However, problems occur that it requires a very complicated construction to render the position at which the two conveyor belts variable, resulting in that cost for production increases and the reliability of change of the direction in which paper is conveyed becomes poor.

SUMMARY OF THE INVENTION

In view of the above-described problems, it is an object of the present invention to provide a paper conveyor which has a simple construction and which can reliably and smoothly switch the direction in which paper is conveyed.

It is another object of the present invention to provide a paper conveyor which has a stand for mounting paper discharged as the result of conveyance and which is adapted such that the paper can be reliably removed or relieved from a switching mechanism for switching the direction in which paper is conveyed (hereafter, convey direction switch mechanism), the convey direction switch mechanism being adapted so that its direction can be changed so as to coincide with that of the stand.

It is still another object of the present invention to provide a paper conveyor which can store paper conveyed on a stand and discharge it therefrom and convey it again to another place or position.

As the result of intensive investigation, it has now been found that the above-described objects of the present invention can be achieved by the provision of a switching mechanism for switching the direction in which paper is conveyed which mechanism can rock follower rolls, that can be pressed onto conveyor rolls and are freely rotatable, around the center axis of the conveyor rolls.

More specifically, the present invention provides a paper conveyor for conveying paper, which comprises conveyor rolls for conveying paper, drive means for driving and rotating the conveyor rolls, follower rolls which can be pressed onto the conveyor rolls and hold paper to be conveyed between themselves and the conveyer rolls to thereby convey the paper in a predetermined direction, and switch means for switching the direction in which the paper is conveyed from one direction to another, wherein the switch means is adapted to control the follower rolls so that the follower rolls can be rocked from one direction to another with its axis of rocking coinciding with an axis of the conveyor rolls, whereby enabling the change of the direction in which paper is conveyed by means of the conveyor rolls and the follower rolls.

Here, the paper conveyor according to the present invention may further comprise a stand for mounting a plurality of pieces of paper discharged as the result of conveyance and the switch means for switching the direction in which the paper is conveyed is adapted to control the position of the follower rolls with respect to the conveyor rolls so that the follower rolls can be rocked between the first position at which the paper is guided and conveyed in a direction toward the stand and the second position at which the paper is guided and conveyed in a direction which is opposite to the direction toward the stand so that the rear edge of the paper guided and conveyed in the direction toward the stand can be removed from between the conveyor rolls and the follower rolls.

The paper conveyor according to the present invention may also comprise, if desired, in addition to the stand for mounting a plurality of pieces of paper discharged by conveyance, discharge rolls for discharging the plurality of pieces of paper stored on the stand, the discharge rolls being provided so as to confront the follower rolls via the paper stored on the stand, and protrusion means for protruding the discharge rolls in a direction toward the follower rolls so as to press and hold the paper between the discharge rolls and the follower rolls so that the paper stored on the stand can be conveyed and discharged by the actions of the follower rolls which are driven by the conveyor rolls and of the discharge rolls.

In a preferred embodiment, the present invention provides a paper conveyor which further comprises, in addition to the above-described components, a base frame comprising first and second side frame plates, a rocking frame comprising first and second side plates, a driving shaft, a follower shaft, at least four bearing portions, first and second pulleys, a driving force transmission belt and a driving motor having a shaft, wherein the first side frame plate of the base frame and the first side plate of the rocking frame are arranged adjacent and parallel to each other, and the second side frame plate and the second side plate are arranged adjacent and parallel to each other, and wherein the conveyor rolls and the follower rolls are mounted on the driving shaft and the follower shaft, respectively, the driving shaft and the follower shaft each have a bearing portion on each end thereof and are supported by the first and second side plates of the rocking frame through the respective bearing portions so that the driving shaft and the follower shaft are parallel to and at a predetermined distance from each other, the follower rolls are capable of contacting the corresponding conveyor rolls during conveyance operation, the driving shaft is also supported by the first and second side frame plates of the base frame through the respective bearing portions, the driving motor is attached to the first side frame plate, with the shaft of the driving motor extending through the first side plate, the first pulley is fixed to one end of the driving shaft which is supported by the first side frame plate and by the first side plate of the rocking frame and the second pulley is fixed to one end of the shaft of the driving motor, and the two pulleys are operatively connected through the driving force transmission belt.

As is apparent from the above-described construction and arrangement, the paper conveyor according to the present invention enables the smooth switching of the direction in which the paper is conveyed. That is, when a rotational force is given to the conveyor rolls by appropriate drive means, the follower rolls, which are pressed so as to be in contact with the conveyor rolls, also rotate and as the result the paper which is held between the conveyor rolls and the follower rolls is conveyed while the rolls are rotating. In the meantime, while the paper is being conveyed, if the the follower rolls are rocked around the conveyor rolls from one position to another desired position in such a manner that the axis of the follower rolls may coincide with the axis of the conveyor rolls, reliable and smooth switching of the direction in which the paper is conveyed can be achieved in response to the rocked position of the follower rolls.

Further, when the position of the follower rolls is moved from the rocked position to a new position at which the paper is guided and conveyed to the direction toward the stand for mounting thereon a plurality of pieces of paper so that the direction in which paper is to be conveyed is changed and the paper is conveyed until an appropriate position at which the front edge of each piece of paper is arranged neatly on a predetermined line on the stand, then the follower rolls are rocked to a position at which the paper is guided in a direction which is opposite to the direction of the stand, and the rear edge of each piece of paper held between the conveyor rolls and the follower rolls can be released with ease and each paper is discharged therebetween.

Furthermore, when an appropriate number of pieces of paper are conveyed to the stand and a certain operation, for instance, binding operation is carried out by means of an automatic sheet setter, the discharge rolls arranged so as to confront the follower rolls via the paper which is stored on the stand is pushed and protruded toward the direction of the follower rolls by appropriate protruding means, with the result that the paper stored on the stand is pressed and held between the discharge rolls and the follower rolls and conveyed and discharged by the actions of the follower rolls, to which a rotational force is given by the conveyor rolls, and of the discharge rolls.

The above and other objects, effects, features and advantages of the present invention will become more apparent from the following description of embodiments thereof taken in conjunction with the accompanying drawings.

BRIEF DESCRIPTION OF THE ACCOMPANYING DRAWINGS

Figure 10:
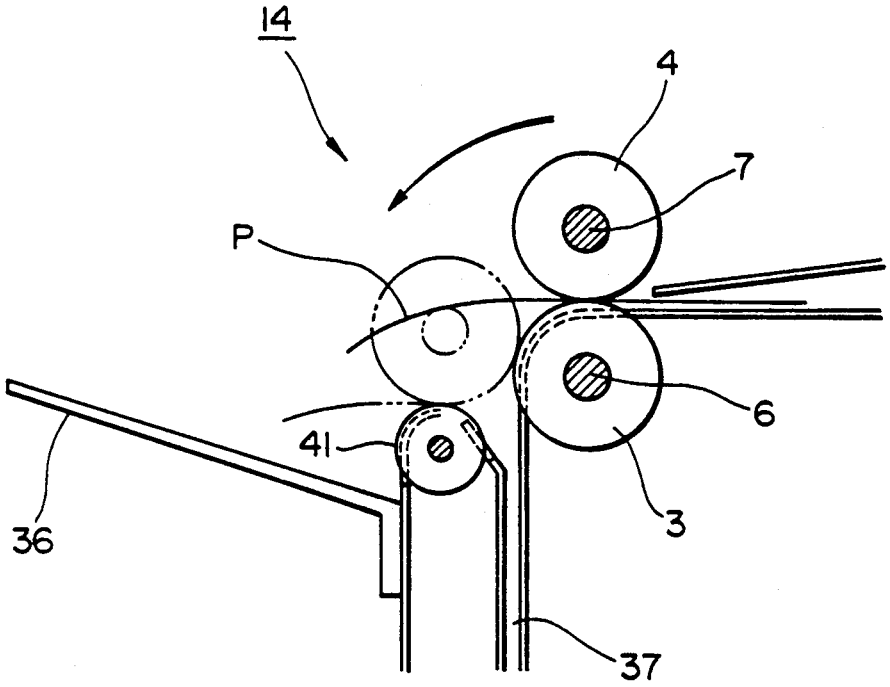
Figure 11:
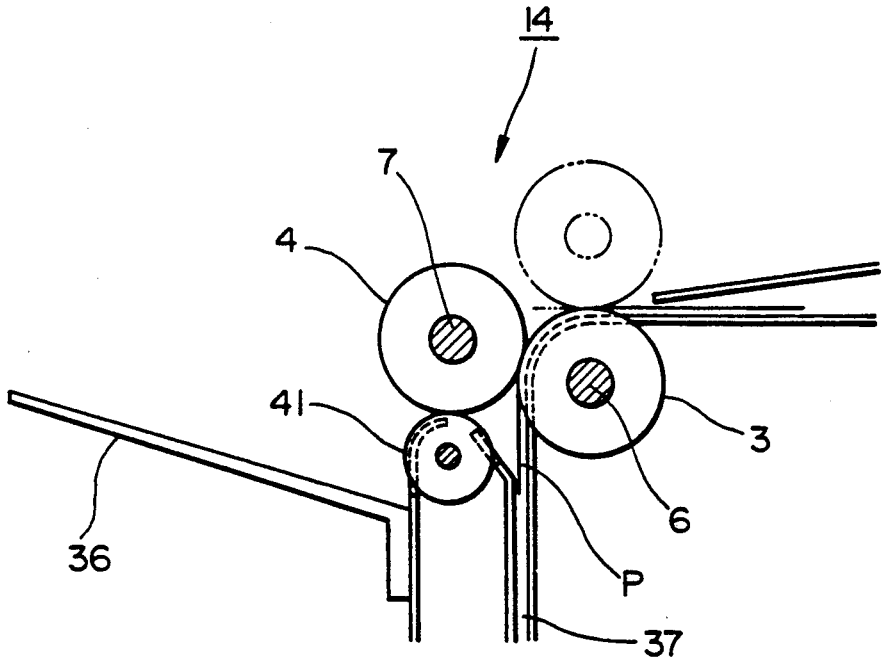

FIG. 10 is a schematic partial view of the paper conveyor according to another embodiment of the present invention, illustrating a state where the direction in which the paper is conveyed is switched from one of two directions to another, i.e., in a substantially horizontal direction toward a tray; and FIG. 11 is a schematic partial view of the paper conveyor according to another embodiment of the present invention, illustrating a state where the direction in which the paper is conveyed is switched from one of two directions to another, i.e., in a vertical direction downward.

DESCRIPTION OF PREFERRED EMBODIMENTS

Figure 1:
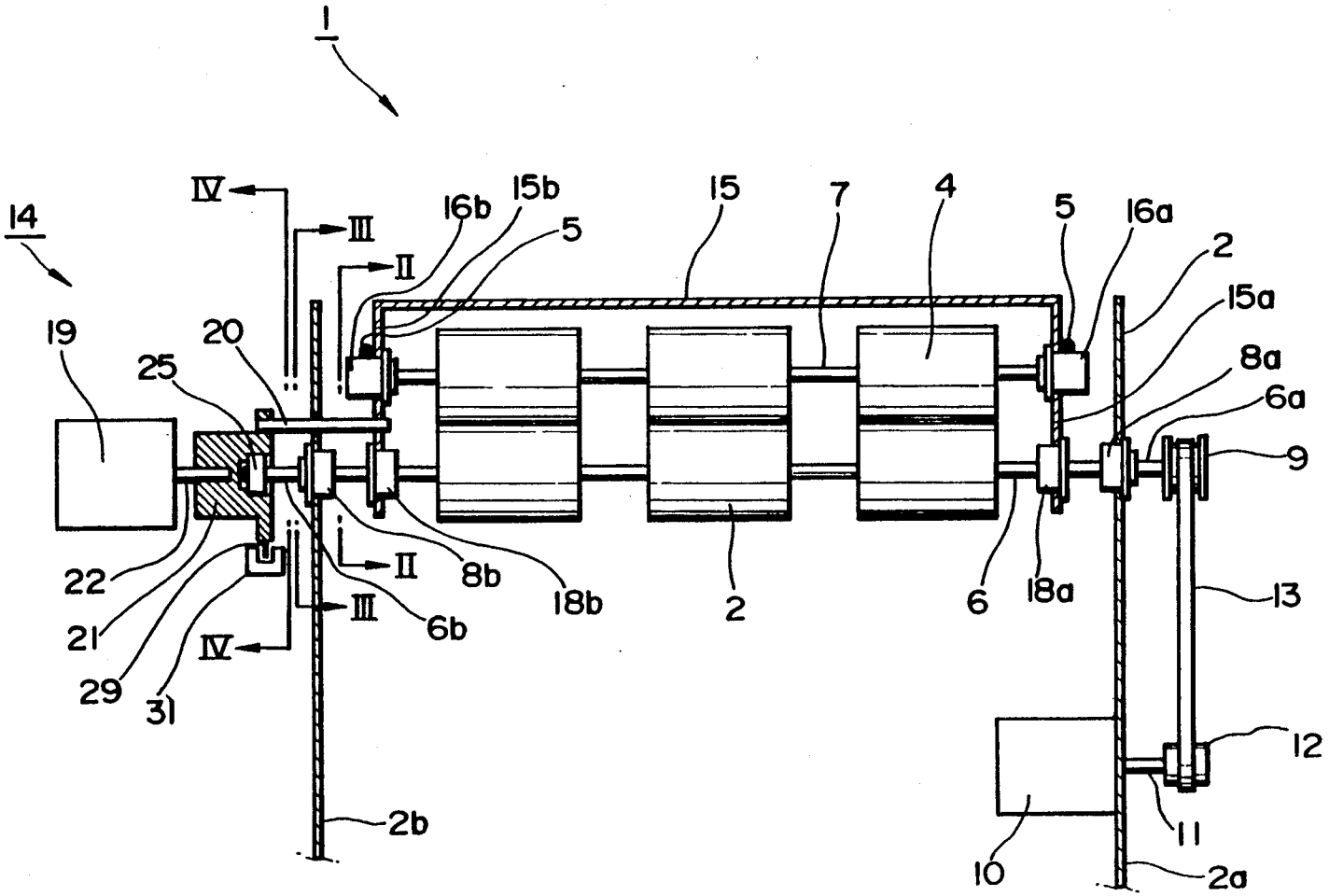
FIG. 1 is a cross-sectional view of the main part of the paper conveyor according to one embodiment of the present invention.
Figure 5:
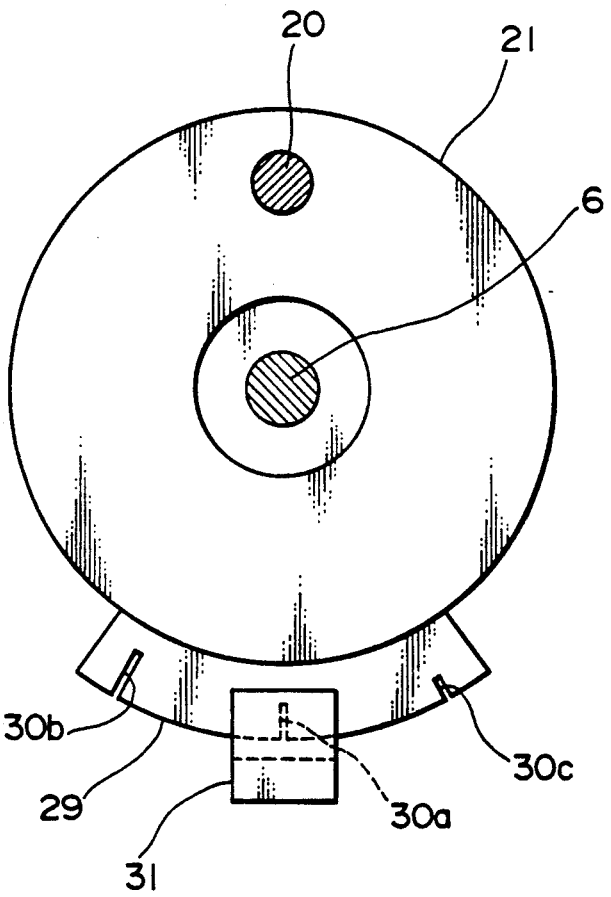
FIG. 5 is a cross-sectional view of the main part of the paper conveyor shown in FIG. 1 taken along the line IV—IV.

In FIG. 1, reference numeral 1 denotes generally a paper conveyor according to an embodiment of the present invention, which includes a base frame 2 of a paper conveyor. The base frame 2 is composed of two confronting side frame plates 2*a* and 2*b*. The side frame plates 2*a* and 2*b* are positioned parallel to and at a predetermined distance from each other. Conveyor rolls 3 (in the embodiment shown in FIG. 1 there are three conveyor rolls), which are given a rotational force by appropriate drive means and follower rolls 4 (in this embodiment there are three follower rolls), which are each pressed onto the corresponding conveyor rolls 3 and can be rotated freely, are provided between the two side frame plates 2*a* and 2*b*. The conveyor rolls 3 and the follower rolls 4 are constructed so that they can hold paper P therebetween and convey it out as the conveyor rolls 3 rotate. More specifically, as shown in FIG. 5, the follower rolls 4 are always, during conveyance operation, pressed onto the corresponding conveyor rolls 3 by means of a compression spring 5. The conveyor rolls 3 are mounted on a common driving shaft 6 which is supported by the side frame plates 1 and 1*b* via respective bearing portions 8*a* and 8*b*. On the other hand, the follower rolls 4 are mounted on a common follower shaft 7. The driving shaft 6 is provided with a pulley 9 on one end thereof (the right hand side end in FIG. 1), which extends through the right hand side side frame plate (first side frame plate) 1*a*. On the other hand, a driving motor 10 is fixed to one of the side frame plates 2*a* and 2*b* (in FIG. 1, the right hand side frame plate 1*a*). The driving motor 10 has a shaft 11 which extends through the side frame plate 1*a*. The shaft 11 is provided with a pulley 12 on its free end (the one opposite to the end which is fixed to the core of the motor 5). The pulleys 9 and 12 are combined with a driving force transmission belt 13, which transmits the rotational driving force generated by the driving motor 10 to the driving shaft 6 of the conveyor rolls 3.

A mechanism 10 for switching the direction of paper P to be conveyed is provided. The convey direction switch mechanism 14 controls the follower rolls 4 in such a manner that they can be rocked around the center axis of the driving shaft 6 of the conveyor rolls 3 to thereby change the direction in which the paper P is conveyed. In this case, the axis of rocking of the follower rolls 4 coincides with the center axis of the driving shaft 6.

Figure 4:
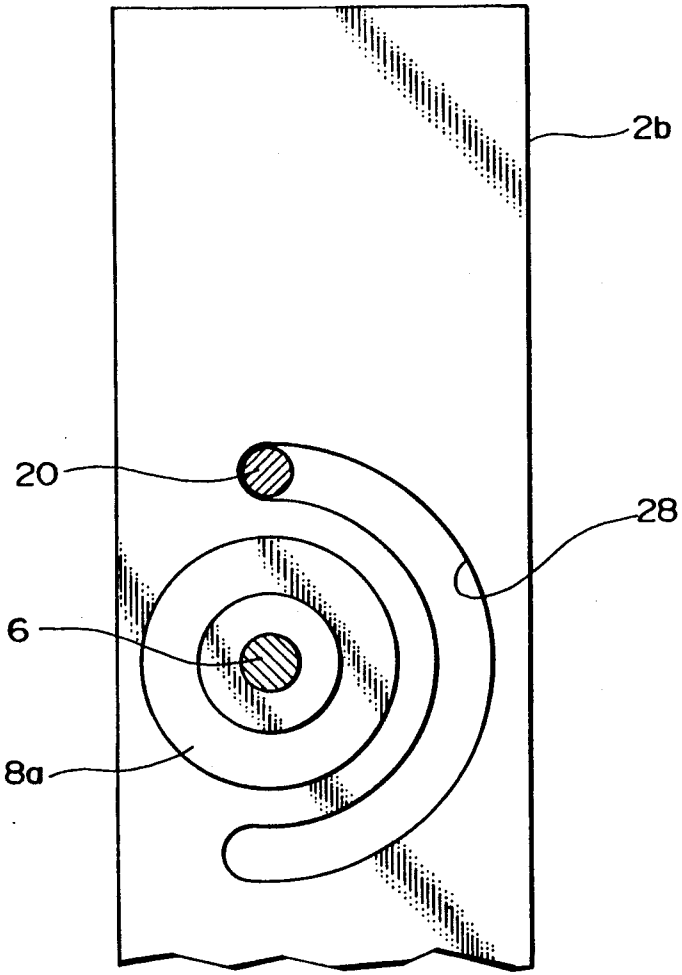
FIG. 4 is a cross-sectional view of the main part of the paper conveyor shown in FIG. 1 taken along the line III—III.
Figure 3:
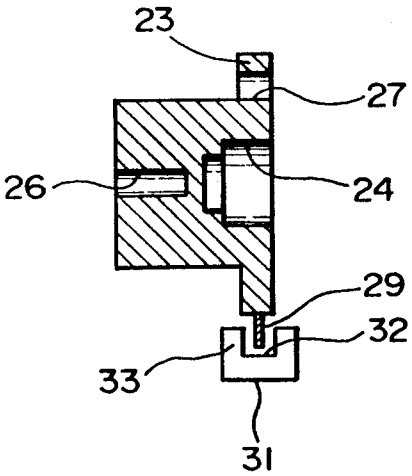
FIG. 3 is an enlarged cross-sectional view of the joint used as a component of the convey direction switch mechanism in the paper conveyor of the present invention.

Hereafter, detailed explanation will be made on the convey direction switch mechanism 14. That is, the follower shaft 7 on which the follower rolls 4 are mounted are arranged in parallel with and at an appropriate distance from the driving shaft 6 so that the follower rolls 4 can be pressed onto the respective conveyor rolls 3 through the paper P during conveyance operation. Both ends of the follower shaft 7 are supported rotatably by a rocking frame 15 through respective bearing portions 16*a* and 16*b*. As shown in FIG. 1, the rocking frame 15, in its front view, generally has an inverted trough-like shape which is placed with its open side being faced downwards or it is of an inverted U-letter form in cross section with rectangular corners. Thus the rocking frame 15 has two wings or side plates 17*a* and 17*b*, which hold therebetween the follower shaft 7 rotatably through the bearing portions 16*a* and 16*b*. On the other hand, the driving shaft 6 is rotatably supported by the side plates 17*a* and 17*b* of the rocking frame 15 through bearing portions 18*a* and 18*b* which are arranged on top portions of the respective side plates 17*a* and 17*b*. The first side frame plate of the base frame and the first side plate of the rocking frame are arranged adjacent and parallel to each other, and the second side frame plate and the second side plate are arranged adjacent and parallel to each other. One of the side plates 17*a* and 17*b* (in FIG. 1, the left hand side one 15*b*), second side plate 17*b* in the instant embodiment, is connected to a convey direction switch motor 19 through a connecting rod 20 and a joint 21. The direction switch motor 19 has a rocking shaft 22, one end of which is supported by the joint 21. The joint 21 is of a generally cylindrical shape and has a flange 23 solid to the cylindrical portion at one end thereof as shown in FIG. 1 in a longitudinal cross section. As shown in FIG. 3, the joint 21 has a recess or cavity 24 for receiving one end 6*b* of the driving shaft 6 that is arranged on the side opposite to the side where there is the end of the driving shaft 6 to which the pulley 9 is attached. The end of the driving shaft 6 is supported by the joint 21 through a bearing portion 25, which is placed in the cavity 24. The joint 21 has another recess 26 for receiving the rocking shaft 22. The rocking shaft 22 is fixed to the joint 21 so that the axis of the rocking shaft 22 may be aligned with the center axis of the driving shaft 6. On the other hand, a hole 27 is formed in the flange 23. The hole 27 is adapted to fixedly hold one end of the connecting rod 20. One of the side frame plates of the base frame 2, i.e., the side frame plate (second side frame plate) 1*b* is formed with a slot 28 which generally is in a form of a portion of a circle such as a hemi-circular shape as shown in FIG. 4. The connecting rod 20 extends through the slot 28 as will be understood from FIGS. 1 and 5, and it can move in the slot 14 such that it is guided along inner walls of the slot 14. That is, the connecting rod 20 is assured of its free rocking movement along the inner walls of the slot 14. Because the hole 27 is arranged in a position biased to some extent with respect to the center axis of the driving shaft 6 as will be clearly understood from FIGS. 1 and 5, the connecting rod 20 is rocked around the driving shaft 6 when the rocking shaft 22 is rotated in an appropriate direction, driven by the rotational force generated by the convey direction switch motor 19.

As the result, the rocking frame 15, which is fixed to the connecting rod 20, is also rocked around the driving shaft 6 in response to the rotation of the rocking shaft 22. This causes the follower rolls 4 to be rocked in an appropriate direction around the driving shaft 6 on which the convey rolls 2 are mounted.

As shown in FIGS. 1 and 5, a position marker plate 29 is provided on the periphery of the flange 23, preferably on a region of the periphery opposite, with respect to the axis of the driving shaft, to the position of the hole 27 in which the connecting rod 20 is housed as shown in FIG. 5. The position marker plate 29 has a shape of a partial disc concentric to the joint in cross section and is formed one or more recesses, e.g., three recesses 30*a*, 30*b* and 30*c* formed as extending in the radial direction as shown in FIG. 5. A position detection sensor 31 is provided as supported by support means (not shown) so as to face the periphery of the position marker plate 29.

Figure 2:
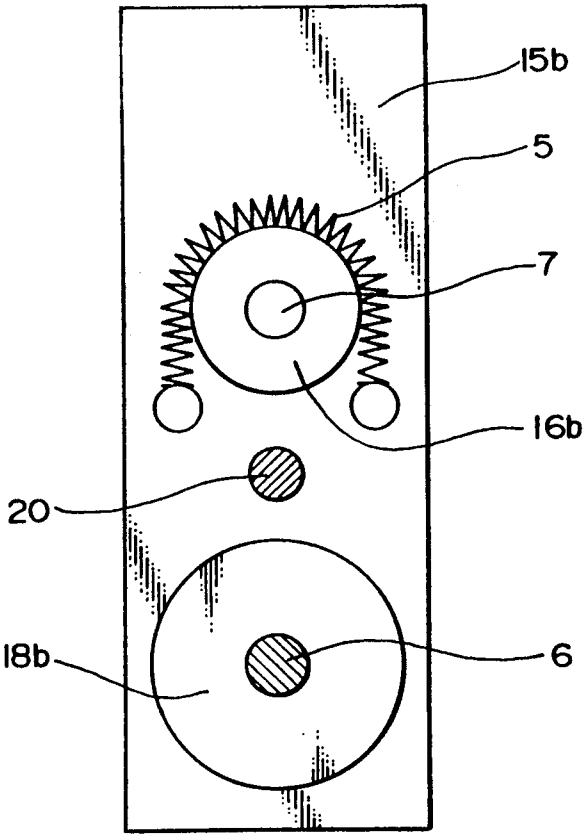
FIG. 2 is a cross-sectional view of the main part of the paper conveyor shown in FIG. 1 taken along the line II—II.

More specifically, the position detection sensor 31 may be a block which is formed with a groove 32 of an appropriate depth and has in cross section a shape of U-letter with rectangular corners as shown in FIG. 2 so that it can receive therein, or between side walls 33 of the groove 32, a portion of the position marker plate 20 as shown in FIGS. 1 and 5. The position detection sensor 31 is provided with a photosensor (not shown) on one of the side walls 33 in order to determine or recognize whether or not light is transmitted from one side wall to anther to thereby detect the position of the slits. In other words, the angular position of the connecting rod 20 around the axis of the driving shaft 6 is indirectly detected or recognized by the photosensor.

The rocking movement of the follower rolls 4 is detected by a paper position sensor (not shown) arranged at a position near the convey rolls 2. That is, when the paper P is conveyed to an appropriate position where it is clamped between the convey rolls 2 and the corresponding follower rolls 4, this position of the paper P is detected by the paper position sensor, which then sends an instruction signal to the convey direction switch motor 19 in order to actuate it. Then, the motor 11 rotates the rocking shaft 22, which in turn rotates the joint 21, with the result that the follower rolls 4 are rocked around the axis of the driving shaft 6. In this case, the system is adapted and controlled such that the follower rolls 4 can be rocked at an appropriate timing and speed so that the paper P may not get out from between the convey rolls 2 and the follower rolls 4 while the follower rolls are being rocked. For example, the speed of conveying the paper P by the convey rolls 2 and the follower rolls 4 is controlled so as to be in synchronization with the speed at which the follower rolls 4 are rocked. This makes it possible to change the direction in which the paper P is conveyed with the paper P being held or clamped between the convey rolls 2 and the follower rolls 4. Alternatively, the convey direction may be switched by rendering the speed of rocking of the follower rolls 4 faster than the speed of conveying the paper P after it has been conveyed halfway. As described above, the synchronization of the speed of conveying the paper P with the speed of rocking of the follower rolls 4 enables reliable switching of the direction in which the paper P is conveyed without getting out of the paper P from between the convey rolls 2 and the follower rolls 4 while the latter are being rocked.

The position to which the follower rolls are rocked, that determines in turn the direction in which the paper P is conveyed, is controlled based on the angle of rotation of the shaft 12 of the direction switch motor 19. For example, as shown in FIGS. 1 and 5, the position of the marker plate 29 provided on the periphery of the joint 21, more specifically the position of one of the three slits 30*a*, 30*b* or 30*c* (FIG. 5), is detected by the photosensor (not shown) on the position detection sensor 31 while the plate 29 travels in the groove of the position detection block 20. At this moment, the photosensor produces and sends a signal to a circuit (not shown) which controls the operation of the direction switch motor 19 so that the rotation of the rocking shaft 22 of the motor 11 can be stopped at a predetermined angular position. As the result the rotation or rocking of the connecting rod 20, which is concentric to the axis of the joint 12 and thus to that of the rocking shaft 22, around the axis of the joint 21 is stopped to a predetermined angular position. Therefore, the rocking frame 15 supporting the conveyor rolls 3 and follower rolls 4 through the driving shaft 6 and the follower shaft 7, respectively, is stopped after it has been rocked to a predetermined position in accordance with the amount of the rocking movement of the connecting rod 20, i.e., the rocking movement of the slits in the position marker plate 29 which is monitored by the photosensor (not shown). As will be explained in detail hereinbelow, the rocking frame 15 may take generally three positions, i.e., (a) a position of paper conveyance in ordinary direction at which position the paper P is conveyed in an ordinary manner, that is, in a direction in which the paper P is conveyed as it is without change in the direction after an operation such as copying in a copying machine or printing in a laser printer; (b) a position of paper conveyance in the direction toward a stand 34 for mounting thereon the paper P; and (c) a position of paper conveyance in the direction opposite to the direction toward the stand 34, in which case the rear end of the paper P comes out from between the driving rolls 2 and follower rolls 4. In the embodiment shown in FIG. 5, the three positions (a), (b) and (c) correspond, for example, to the slits 30*a*, 30*b* and 30*c*, respectively. The position detection sensor 31 and the position marker plate 29 are not limited to those described above and illustrated in the FIGS. 1 and 5, and there may also be used various other sensors such those having mechanical constructions such as limit switches and those utilizing magnetic field.

The rocking moment of the follower rolls 4 in the convey direction switch mechanism 14 is controlled by a suitable conventional control device such as a computer (not shown). In this case, the rocking of the follower rolls 4 can be controlled by controlling the operation and rotational speed of the direction switch motor 19.

Figure 6:
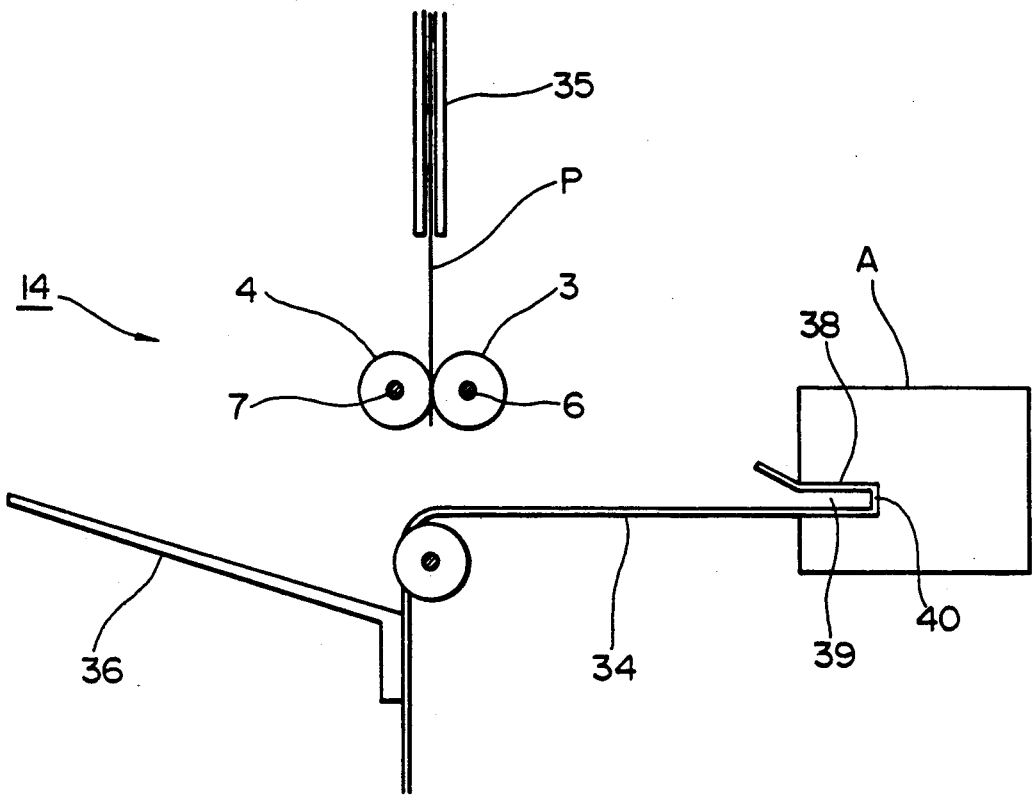
FIG. 6 is a schematic partial view of the paper conveyor according to one embodiment of the present invention; illustrating a state before switching the direction in which paper is conveyed.
Figure 7:
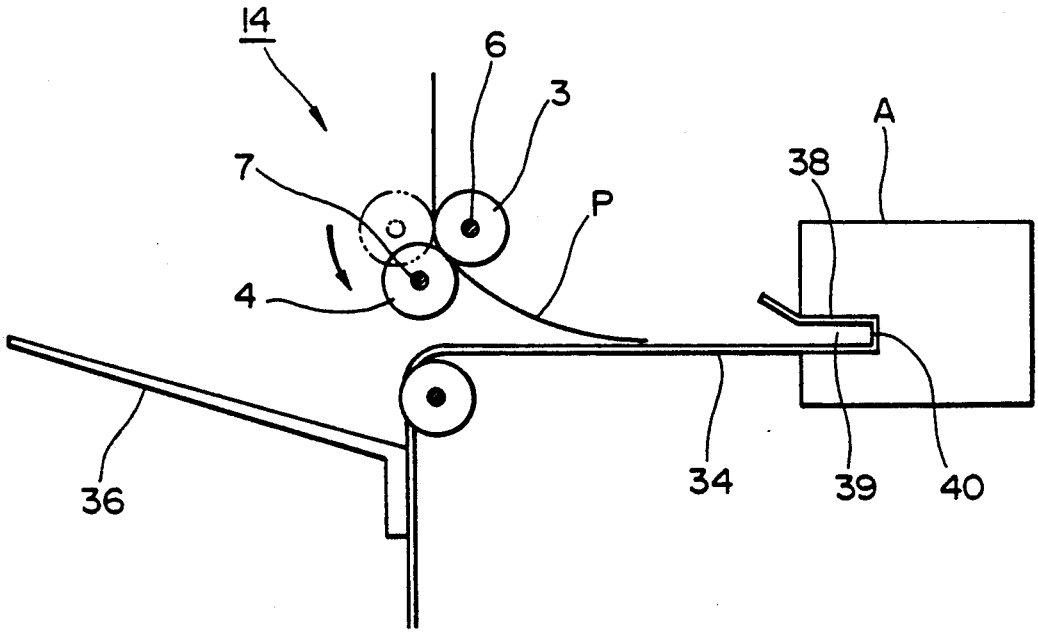
FIG. 7 is a schematic partial view of the paper conveyor according to one embodiment of the present invention, illustrating a state during switching the direction in which paper is conveyed.

Referring to FIGS. 6 to 9, more concrete explanation will be made on the operation of switching the direction in which the paper P is conveyed. For example, the direction in which the paper P is conveyed may be changed to the direction toward the stand 34 as illustrated in FIGS. 6 and 7.

More specifically, as shown in FIG. 6, the paper P is conveyed to the instant conveyor rolls 3 and follower rolls 4 in the convey direction switch mechanism 14 from other sets of the conveyor rolls and the follower rolls (not shown) through a conveyance route 35, which may be fixed by appropriate supporting means to an appropriate member of the apparatus such as base frame 2. The thus conveyed paper P is then received by the conveyor rolls 3 and the follower rolls 4 and passed therebetween. Then, as shown in FIG. 7, the follower rolls 4 are rocked in the direction toward the stand 34 by the rotation of the direction switch motor 19 until a position is reached at which the predetermined portion of the position marker plate 29, or the slit 30*a*, is detected by the photosensor on the position detection sensor 31. As soon as the photosensor detects the slit 30*a* it issues a signal for stopping the rotation of the direction switch motor 19 and as the result the rotation of the motor 11 is stopped. In the meantime, the follower rolls 4 are rocked a little further to finally reach the predetermined position where they are stopped. As stated above, the timing and speed of rocking movement of the follower rolls 4 is controlled appropriately so that the rolls 3 are stopped at right position in the direction toward the stand 34. As the result, an imaginary plane including both of the driving shaft 6 and the follower shaft 7 is inclined in such a manner that the front edge of the paper P which have just passed through between the conveyor rolls 3 and the follower rolls 4 is turned (counterclockwise in FIG. 7) and directed toward the stand 34 (FIG. 7, toward right hand side). Therefore, the direction in which the paper P is conveyed is changed so that the paper P can be conveyed toward the stand 34 as shown in FIG. 7.

After a predetermined period of time has elapsed in which the front edge of the paper P is arranged at a predetermined position on the stand 34, the direction switch motor 19 is rotated in the opposite direction and in accordance with this change, the follower rolls 4 are rocked in a direction opposite to the previous direction. Alternatively, the rotation of the direction switch motor 19 may be controlled by providing a sensor for detecting if the front end of the paper P has reached right position on the stand 34, more specifically, at the position at which the front edge of the paper P is arranged on a predetermined line, and sending a signal from the sensor which instructs the direction switch motor 19 to rotate in the opposite direction.

When the motor 11 is operated to rotate in the opposite direction, the follower rolls 4 are rocked in the opposite direction (clockwise in FIG. 8) accordingly and after a certain period of time they reach a position at which a predetermined portion of the position marker plate 29 (the slit 30*b* in the embodiment shown in FIG. 5) is detected by the position detection sensor 31, and as soon as the photosensor detects the slit 30*b* it issues a signal for stopping the rotation of the direction switch motor 19 and as the result the rotation of the motor 11 is stopped. During the time from the detection of the slit 30*b* to the moment when the they are actually stopped, the follower rolls 4 are rocked a little further and finally reach the predetermined position where they are to be stopped. As earlier explained, the timing and speed of rocking movement of the follower rolls 4 is controlled appropriately so that the rolls 3 are stopped at right position in a direction opposite to that of the stand 34. As the result of this operation, an imaginary plane including both of the axis of the driving shaft 6 and that of the follower shaft 7 is inclined in the opposite direction. This new arrangement of the conveyor rolls 3 and the follower rolls 4 facilitates coming out of the rear edge of the paper P which is going to pass through between the conveyor rolls 3 and the follower rolls 4 in short, with the result that the paper P can be smoothly discharged from between the conveyor rolls 3 and the follower rolls 4.

Figure 8:
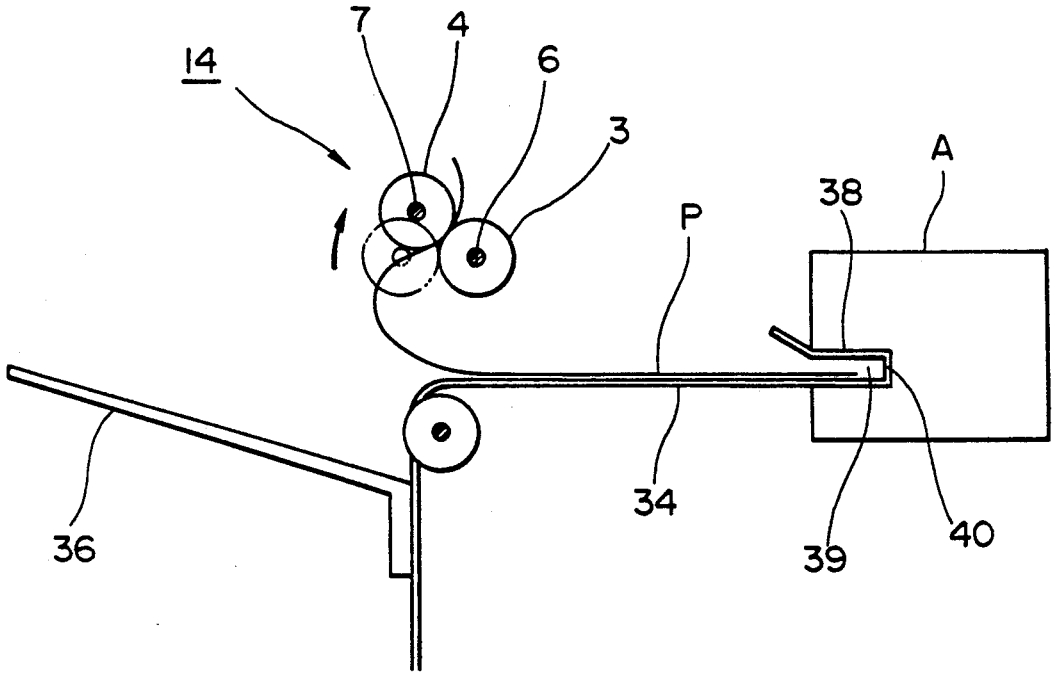
FIG. 8 is a schematic partial view of the paper conveyor according to one embodiment of the present invention, illustrating a state after further switching the direction in which paper is conveyed in order to facilitate the release of the rear end of the paper.
Figure 9:
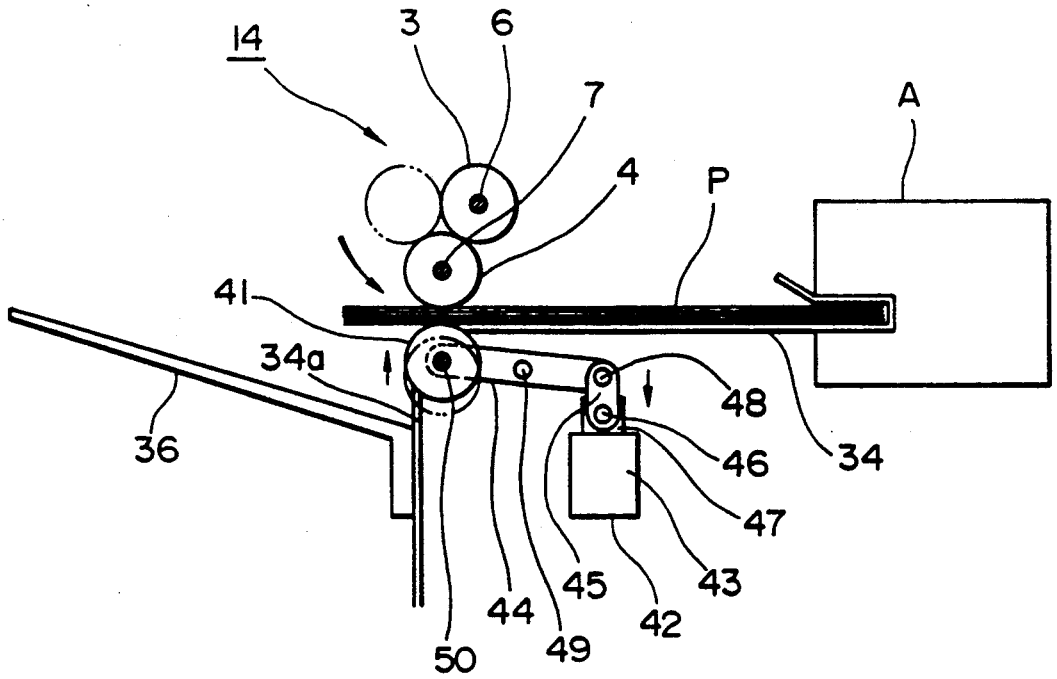
FIG. 9 is a schematic partial view of the paper conveyor according to another embodiment of the present invention, illustrating a state in which paper stored on a stand is automatically discharged.

By repeating the above-described operation, a number of pieces of the paper P (hereafter, paper sheets) is accumulated on the stand 34, and the paper sheets are then bound by an automatic sheet binder A connected to the stand 34 as shown in FIGS. 8 and 9. The automatic sheet binder A is provided with a recess or cavity 38 for receiving paper sheets. Usually, one end of the stand 34 extends into the cavity and form a pocket 39 in which paper sheet can be stored until they are bound or while they are being bound or after the binding although the pocket 39 can be formed separately from the stand 34 on the side of the automatic sheet binder A and connected to the stand 34 so as to be flush therewith. The pocket 39 has upright end wall 40, which is at the deepest position in the cavity, so that the front edges of the paper sheets can contact it and can thus be arranged on the same vertical plane.

As shown in FIG. 9, a batch of the paper sheets P bound by the automatic sheet binder A can be automatically discharged from on the stand 34 and transferred to the tray 36 attached to the stand 34 on its side portion 34*a* extending downward. More specifically, freely rotatable discharge rolls 41 are provided below the follower rolls 4 when the latter rolls are at the lowermost position as shown in FIG. 9 so as to confront the corresponding follower rolls 4. The discharge rolls 41 are supported and operated by protrusion means 42. The protrusion means 42 includes a solenoid system 43, which is connected to a rocker arm 44 via a lever 45. One end of the lever 45 is connected rotatably by a pin joint 46 to a rod 47 of a core of an electromagnet of the solenoid system 43. Another end of the lever 45 is connected rotatably by a pin joint 48 to one end of the rocker arm 44. The rocker arm 44 is supported by support means (not shown) at a position 25 serving as fulcrum and the both ends thereof can be rocked around the fulcrum. Another end of the rocker arm 44 is connected to a shaft 50 mounting thereon the discharge rolls 41. When the electromagnet of the solenoid 24 is energized, the rod 47 is pulled down by magnetic force generated by the magnet and the rod 47 in turn pulls down one end of the rocker arm 44 to which it is connected. This causes the rocker arm to be rocked around the fulcrum 49, with the result that the shaft 50 and accordingly the discharge rolls 41 are pushed up toward the follower rolls 4 until the batch of paper P is tightly held by the follower rolls 4 and the discharge rolls 41 therebetween. The follower rolls 4 are driven by the respective corresponding conveyor rolls 3 and the batch of paper P stored on the stand 34 is discharged therefrom and directly conveyed by the actions of the rolls 3 and 22 to the tray 36 while the conveyor rolls 3 are rotated.

Furthermore, utilizing the convey direction switch mechanism 14, the paper P can be conveyed in at least two directions or routes selectively. For example, a selection can be made between a direction of paper conveyance in which the paper P is conveyed as it is as shown in FIG. 10 and a direction of paper conveyance in which the paper P is conveyed along a convey route 37 as shown in FIG. 11. More specifically, the discharge rolls 41 are disposed in the direction in which the paper P is to be conveyed along the horizontal part of the stand 34 at a predetermined distance from the downward side portion of the stand 34 and by a predetermined distance lower than the level of the horizontal plane of the stand 34. The discharge rolls 41 are the same as those described above and therefore are rotatable and supported by support means (not shown). The convey route is arranged between the discharge rolls 41 and the conveyor rolls 3. On the other hand, the tray 36 is arranged slightly below the discharge rolls 41 and on the side opposite, with respect to the discharge rolls 41, to that on which the conveyor rolls 3 are positioned (in the direction in which the paper P is conveyed). As shown in FIG. 10, when the paper P is discharged to the tray 36, at first the paper P is conveyed by the conveyor rolls 3 and the follower rolls 4 until the front edge of the paper P reaches at least the position of the discharge rolls 41 and then the follower rolls 4 are rocked so that the paper P can be held or clamped tightly between the follower rolls 4 and the discharge rolls 41, followed by conveying the paper P as it is to the tray 36. On the other hand, when it is to be conveyed along the convey route 37, the paper P is conveyed by the conveyor rolls 3 and the follower rolls 4 in such a state that the front edge thereof is clamped between the conveyor rolls 3 and the follower rolls 4 while the follower rolls 4 are being rocked, under control by appropriate control means such as computer (not shown), around the axis of the driving shaft 6 at a speed which is brought in synchronization with the speed of conveying the paper P to thereby change the direction in which the paper P is conveyed toward the convey route 37, and the paper P is conveyed as it is in the direction along the convey route 37.

The present invention is not limited to the above-described embodiments and various modifications and variations can be made with respect to the arrangements and numbers of the conveyor rolls 3, the arrangement and construction of the driving motor 10, and the construction of the convey direction switch mechanism 14 as well as other components.

Because of the provision of (1) the conveyor rolls 3 to which a rotational force is given by appropriate driving means such as driving motor 10, (2) the follower rolls 4 which are pressed onto the conveyor rolls 3 and are freely rotatable, and (3) the convey direction switch mechanism 14 which controls the rocking movement of the follower rolls 4 around the axis of the conveyor rolls 3 in order to change or switch the direction in which the paper P is conveyed, the paper conveyor of the present invention, when a rotational force is given to the conveyor rolls 3 by appropriate driving means, causes the follower rolls 4 to be also rotated due to the contact with the conveyor rolls 3. The paper P is conveyed by the rotation of the conveyor rolls 3 and follower rolls 4 while it is being held between the two types of rolls. In the midway of paper conveyance, the follower rolls 4 can be rocked by the convey direction switch mechanism 14 around the axis of the driving shaft 6 which mount thereon the conveyor rolls 3 with holding the paper P between the two types of rolls. In accordance with this rocking movement of the rolls 3, the direction in which the paper P is conveyed can be switched reliably and smoothly. Therefore, clogging of paper does not occur any longer. In addition, it is also possible to switch the direction in which paper is conveyed even when conveying paper made of soft sheet materials which have heretofore been difficult to use in paper conveyors including conventional convey direction switch means.

The rocking of the follower rolls 4 in the switch mechanism 14 can be effected by controlling the timing of actuation and speed of rotation of the motor 11 by using appropriate control device such as computer and therefore a device can be provided of which the operation of the mechanism 10 is highly reliable with less possibilities of occurrence of misoperation and troubles.

As state earlier, the paper conveyor of the present invention includes the stand 34 for mounting thereon a number of pieces of paper P discharged as the result of conveyance and the convey direction switch mechanism 14 which controls the rocking of the follower rolls 4 such that the position of the follower rolls 4 with respect to that of the conveyor rolls 3 can be selected from at least two positions, i.e., (1) the one at which the paper P is conveyed in the direction toward the stand 34 and (2) the other at which the paper P is guided in a direction opposite to that toward the stand 34 so that the rear edge of the paper P guided and conveyed in the direction toward the stand 34 can be easily removed from between the conveyor rolls 3 and the follower rolls 4. This construction makes it possible to discharge the paper P tightly held between the conveyor rolls 3 and the follower rolls 4 from between the rolls 2 and the rolls 3 without its rear edge getting entangled because with the control by the mechanism 10, the rolls 3 are rocked to a position at which the paper P can be guided in the direction toward the stand 34, resulting in that the direction in which the paper P is conveyed is changed toward the stand 34, and as soon as the paper P is conveyed to an appropriate position at which the front edge of the paper P is arranged along a predetermined line on the stand 34 the follower rolls 4 are rocked to a position at which the paper P is guided in a direction opposite to that toward the stand 34.

In other words, if the paper P were continued to be fed as it is in the direction toward the stand 34, the rear edge of the paper P would be got entangled with the follower rolls 4, which could make it difficult for the paper P to come out from between the convey rolls 2 and the follower rolls 4. This defect is particularly remarkable in the case where the paper P is larger in size than the stand 34. If the paper P were continued to be conveyed despite stopping of its front edge on the 21, the paper P would be curled to cause its entanglement with the conveyor rolls 3 or the follower rolls 4, with the result that clogging of the paper P could occur. On the contrary, with the construction of the paper conveyor according to the present invention, the follower rolls 4 are rocked to a position at which the rear edge of the paper P is guided in a direction opposite to the direction toward the stand 34, and accordingly the rear edge of the paper P is conveyed in a direction opposite to the direction toward the stand 34, which prevents the paper P from being got entangled and facilitates its coming out from between the conveyor rolls 3 and the follower rolls 4.

Furthermore, in the paper conveyor of the present invention, (1) the stand 34 for mounting thereon a number of pieces of paper P discharged upon conveyance, (2) the discharge rolls 41 confronting the follower rolls 4 through the paper P stored on the stand 34, and (3) the protrusion means 42 for protruding the discharge rolls 41 toward the follower rolls 4 are operatively combined so that the paper P stored on the stand 34 can be tightly held between the discharge rolls 41 and the follower rolls 4 and conveyed by the actions of the follower rolls 4 to which a rotational force is given by the conveyor rolls 3 and of the discharge rolls 41, and the paper P can be discharged from between the rolls 22 and the rolls 3. As the result, when a suitable number of pieces of paper P are conveyed onto the stand 34 and appropriate treatment such as binding by the automatic sheet binder A is effected, the discharge rolls 41, arranged as confronting the follower rolls 4, are pushed toward the follower rolls 4 by the protrusion means 42 so that the paper P is tightly held or clamped between the discharge rolls 41 and the follower rolls 4, resulting in that when a rotational force is transmitted from the conveyor rolls 3 to the follower rolls 4, the paper P on the stand 34 can be conveyed by the follower rolls 4 and the discharge rolls 41.

Therefore, after it is subjected to suitable treatment such as binding by connecting the automatic sheet binder A, the paper P can be automatically discharged therefrom, which increases the application flexibility of treatment of paper P. This is not only convenient but also makes it possible to realize with a very simple construction, with the result that reduction in production costs of the apparatus and miniaturization to a greater extent can readily be achieved.

The invention has been described in detail with respect to embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A paper conveyor comprising conveyor rolls for conveying paper, drive means for driving and rotating the conveyor rolls, follower rolls which are pressed onto the conveyor rolls and hold paper to be conveyed between themselves and the conveyor rolls to thereby convey the paper in a predetermined direction, and a switch mechanism for switching the direction in which the paper is conveyed from one direction to another, the conveyor rolls, the follower rolls, the drive means and the switch mechanism being operatively connected to each other, wherein the switch mechanism is adapted to control the follower rolls so that the follower rolls can be rocked from one direction to another with their axis of rocking coinciding with an axis of the conveyor rolls, whereby enabling change of the direction in which paper is conveyed by means of the conveyor rolls and the follower rolls, further comprising a base frame comprising first and second side frame plates, a rocking frame comprising first and second side plates, a driving shaft, a follower shaft, at least four bearing portions, first and second pulleys, a driving force transmission belt and a driving motor having a shaft, wherein the first side frame plate of the base frame and the first side plate of the rocking frame are arranged adjacent and parallel to each other, and the second side frame plate and the second side plate are arranged adjacent and parallel to each other, and wherein the conveyor rolls and the follower rolls are mounted on the driving shaft and the follower shaft, respectively, the driving shaft and the follower shaft each have a bearing portion on each end thereof and are supported by the first and second side plates of the rocking frame through the respective bearing portions so that the driving shaft and the follower shaft are parallel to and at a predetermined distance from each other, the follower rolls are capable of contacting the corresponding conveyor rolls during conveyance operation, the driving shaft is also supported by the first and second side frame plates of the base frame through the respective bearing portions, the driving motor is attached to the first side frame plate, with the shaft of the driving motor extending through the first side plate, the first pulley is fixed to one end of the driving shaft which is supported by the first side frame plate and by the first side plate of the rocking frame and the second pulley is fixed to one end of the shaft of the driving motor, and the two pulleys are operatively connected through the driving force transmission belt.

2. A paper conveyor comprising conveyor rolls for conveying paper, drive means for driving and rotating the conveyor rolls, follower rolls which are pressed onto the conveyor rolls and hold paper to be conveyed between themselves and the conveyor rolls to thereby convey the paper in a predetermined direction, and a switch mechanism for switching the direction in which the paper is conveyed from one direction to another, the conveyor rolls, the follower rolls, the drive means and the switch mechanism being operatively connected to each other, wherein the switch mechanism is adapted to control the follower rolls so that the follower rolls can be rocked from one direction to another with their axis of rocking coinciding with an axis of the conveyor rolls, whereby enabling change of the direction in which paper is conveyed by means of the conveyor rolls and the follower rolls, further comprising a stand for mounting thereon a number of pieces of paper discharged from between the conveyor rolls and the follower rolls by conveyance, the stand being provided near the conveyor rolls and the follower rolls, and wherein the switch mechanism is adapted to control the position of the follower rolls with respect to the conveyor rolls so that the follower rolls can be rocked between a first position at which the paper is guided and conveyed in a direction toward the stand and a second position at which the paper is guided and conveyed in a direction opposite to the direction toward the stand so that coming our of rear edge of the paper guided and conveyed in the direction from between the conveyor rolls and the follower rolls can be facilitated, further comprising a base frame comprising first and second side frame plates, a rocking frame comprising first and second side plates, a driving shaft, a follower shaft, at least four bearing portions, first and second pulleys, a driving force transmission belt and a driving motor having a shaft, wherein the first side frame plate of the base frame and the first side plate of the rocking frame are arranged adjacent and parallel to each other, and the second side frame plate and the second side plate are arranged adjacent and parallel to each other, and wherein the conveyor rolls and the follower rolls are mounted on the driving shaft and the follower shaft, respectively, the driving shaft and the follower shaft each have a bearing portion on each end thereof and are supported by the first and second side plates of the rocking frame through the respective bearing portions so that the driving shaft and the follower shaft are parallel to and at a predetermined distance from each other, the follower rolls are capable of contacting the corresponding conveyor rolls during conveyance operation, the driving shaft is also supported by the first and second side frame plates of the base frame through the respective bearing portions, the driving motor is attached to the first side frame plate, with the shaft of the driving motor extending through the first side plate, the first pulley is fixed to one end of the driving shaft which is supported by the first side frame plate and by the first side plate of the rocking frame and the second pulley is fixed to one end of the shaft of the driving motor, and the two pulleys are operatively connected through the driving force transmission belt.

3. A paper conveyor as claimed in any one of claims 1 or 2, further comprising compression springs attached to each of the side frame plates, and wherein the compression springs press, during conveyance operation, the follower rolls onto the conveyor rolls through the respective bearing portions attached to the respective ends of the follower shaft so that paper can be conveyed by actions of the conveyor rolls and of the follower rolls.

4. A paper conveyor as claimed in any one of claims 1 or 2, wherein the driving shaft is provided with a bearing portion on its end on the side of the second side frame plate and opposite to the side of the second side plate of the rocking frame with respect to the second side frame plate, and the second side frame plate is formed with an arcuate slot extending on an arc of a circle concentric to the driving shaft, and wherein the conveyance direction switch mechanism comprises a conveyance direction switch motor having a rocking shaft, a joint of a generally cylindrical shape having first and second recesses along its center axis, the first and second recesses being concentric to each other in a vertical cross section, and a flange on one end thereof solidly connected to the cylindrical portion, the flange being formed with a through hole, the first recess being adapted to fixedly receive one end of the rocking shaft and the second recess being adapted to rotatably receive, through the bearing portion, one end of the conveyor shaft extending through the second side frame plate, a connecting rod, one end of which is fixedly fitted in the hole formed in the flange of the joint and the other end of which is attached to the second side plate of the rocking frame, the connecting rod extending through the arcuate slot and being capable of rocking therein.

5. A paper conveyor as claimed in claim 4, wherein the conveyance direction switch mechanism further comprises a position marker plate attached to a periphery of the flange of the joint at a position, in a vertical transverse cross section, generally opposite to the connecting rod with respect to the driving shaft, the position marker plate being formed with a plurality of slits serving as a position marker, and a position detection sensor for detecting positions of the slits, the position detection sensor being formed with a groove having side walls in which groove the position marker plate travels, one of the side walls being provided therein a sensor for detecting the slits, the position detection sensor being capable of issuing a signal upon detection of the position of one of the slits and sending the signal to the conveyance direction switch motor to actuate or deactuate the motor, and control means operatively communicated to the position detection sensor and adapted for controlling actions of the conveyance direction switch motor, timing and speed of rotation or rocking of the follower rolls and timing and speed of rotation of the conveyor rolls so that the follower rolls can be rocked to a proper position for changing a direction in which paper is conveyed.

6. A paper conveyor as claimed in claim 5, wherein the sensor is a photosensor.

7. A paper conveyor as claimed in any one of claim 2, further comprising a conveying route provided between the conveyor rolls and the discharge rolls and substantially below the follower rolls.

* * * * *